US006531397B1

(12) United States Patent
Nagahara et al.

(10) Patent No.: US 6,531,397 B1
(45) **Date of Patent: *Mar. 11, 2003**

(54) METHOD AND APPARATUS FOR USING ACROSS WAFER BACK PRESSURE DIFFERENTIALS TO INFLUENCE THE PERFORMANCE OF CHEMICAL MECHANICAL POLISHING

(75) Inventors: Ronald J. Nagahara, San Jose, CA (US); Dawn M. Lee, Morgan Hill, CA (US)

(73) Assignee: LSI Logic Corporation, Milpitas, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 647 days.

(21) Appl. No.: 09/005,364

(22) Filed: Jan. 9, 1998

(51) Int. Cl.[7] ..... H01L 21/302
(52) U.S. Cl. ..... 438/692; 215/88
(58) Field of Search ..... 438/692, 693, 438/691; 216/38, 88; 451/41, 288, 289, 388, 389

(56) References Cited

U.S. PATENT DOCUMENTS

| | | | | |
|---|---|---|---|---|
| 3,627,338 | A | 12/1971 | Thompson | |
| 4,131,267 | A | 12/1978 | Ono et al. | |
| 4,270,316 | A | 6/1981 | Kramer et al. | 451/41 |
| 4,313,284 | A | 2/1982 | Walsh | 451/288 |
| RE31,053 | E | 10/1982 | Firtion et al. | |
| 4,793,895 | A | 12/1988 | Kaanta et al. | |
| 4,930,264 | A | 6/1990 | Huang | 451/359 |
| 5,036,015 | A | 7/1991 | Sandhu et al. | |
| 5,081,421 | A | 1/1992 | Miller et al. | |
| 5,151,584 | A | 9/1992 | Ebbing et al. | |
| 5,169,491 | A | 12/1992 | Doan | |
| 5,191,738 | A | 3/1993 | Nakazato et al. | 451/41 |
| 5,196,353 | A | 3/1993 | Sandhu et al. | |
| 5,222,329 | A | 6/1993 | Yu | |
| 5,240,552 | A | 8/1993 | Yu et al. | |
| 5,245,790 | A | 9/1993 | Jerbic | |
| 5,245,794 | A | 9/1993 | Salugsugan | |
| 5,265,378 | A | 11/1993 | Rostoker | |
| 5,272,115 | A | 12/1993 | Sato | |
| 5,308,438 | A | 5/1994 | Cote et al. | |
| 5,310,455 | A | 5/1994 | Pasch et al. | |
| 5,321,304 | A | 6/1994 | Rostoker | |
| 5,324,012 | A | 6/1994 | Aoyama et al. | |
| 5,337,015 | A | 8/1994 | Lustig et al. | |
| 5,389,194 | A | 2/1995 | Rostoker et al. | |
| 5,399,234 | A | 3/1995 | Yu et al. | |
| 5,403,228 | A | 4/1995 | Pasch | |

(List continued on next page.)

*Primary Examiner*—Benjamin Utech
*Assistant Examiner*—Duy-Vu Deo
(74) *Attorney, Agent, or Firm*—Beyer Weaver & Thomas, LLP

(57) ABSTRACT

Methods and apparatus for planarizing the surface of a semiconductor wafer by applying non-uniform pressure distributions across the back side of the wafer are disclosed. According to one aspect of the present invention, a chemical mechanical polishing apparatus for polishing a first surface of a semiconductor wafer includes a polishing pad which polishes the first surface of the semiconductor wafer. The apparatus also includes a first mechanism which is used to hold, or otherwise support, the wafer during polishing, and a second mechanism that is used to apply a non-uniform pressure distribution through the first mechanism, directly onto a second surface of the wafer. The second mechanism is further used to facilitate polishing the first surface of the semiconductor wafer such that the first surface of the semiconductor wafer is evenly polished. In one embodiment, the second mechanism is arranged to apply both positive pressure and negative pressure substantially simultaneously across the second surface of the semiconductor wafer.

5 Claims, 4 Drawing Sheets

U.S. PATENT DOCUMENTS 5,405,806 A 4/1995 Pfeister et al.
5,423,716 A 6/1995 Strasbaugh ..... 451/388
5,439,551 A 8/1995 Meikle et al.
5,441,444 A * 8/1995 Nkajima ..... 451/289
5,483,568 A 1/1996 Yano et al.
5,492,594 A 2/1996 Burke et al.
5,516,400 A 5/1996 Pasch et al.
5,531,861 A 7/1996 Yu et al.
5,541,442 A 7/1996 Keil et al. ..... 257/533
5,559,428 A 9/1996 Li et al.
5,561,541 A 10/1996 Sharp et al.
5,584,746 A * 12/1996 Tanaka et al. ..... 451/41
5,595,526 A 1/1997 Yau et al.
5,597,346 A 1/1997 Hempel, Jr. ..... 451/287
5,597,442 A 1/1997 Chen et al.
5,605,487 A 2/1997 Hileman et al. ..... 451/5
5,609,511 A 3/1997 Moriyama et al.
5,624,304 A 4/1997 Pasch et al.
5,626,715 A 5/1997 Rostoker
5,637,185 A 6/1997 Murarka et al.
5,639,388 A 6/1997 Kimura et al.
5,643,046 A 7/1997 Katakabe et al.
5,643,048 A 7/1997 Tyer ..... 451/6
5,643,050 A 7/1997 Chen
5,644,221 A 7/1997 Li et al.
5,647,952 A 7/1997 Chen
5,658,183 A 8/1997 Sandhu et al.
5,660,672 A 8/1997 Li et al.
5,663,797 A 9/1997 Sandhu
5,664,987 A 9/1997 Renteln
5,667,414 A 9/1997 Pan
5,667,433 A 9/1997 Mallon
5,667,629 A 9/1997 Pan et al.
5,668,063 A 9/1997 Fry et al.
5,670,410 A 9/1997 Pan
5,672,091 A 9/1997 Takahashi et al.
5,674,784 A 10/1997 Jang et al.
5,695,660 A 12/1997 Litvak
5,700,180 A 12/1997 Sandhu et al.
5,705,435 A 1/1998 Chen
5,707,051 A 1/1998 Tsuji
5,710,076 A 1/1998 Dai et al.
5,712,185 A 1/1998 Tsai et al.
5,720,845 A * 2/1998 Liu ..... 156/345
5,722,875 A 3/1998 Iwashita et al.
5,733,182 A 3/1998 Muramatsu et al. ..... 451/289
5,741,171 A 4/1998 Sarfaty et al.
5,747,386 A * 5/1998 Moore ..... 438/691
5,759,918 A * 6/1998 Hoshizaki et al. ..... 438/692
5,762,539 A * 6/1998 Nakashiba et al. ..... 451/41
5,777,739 A 7/1998 Sandhu et al.
5,797,789 A 8/1998 Tanaka et al. ..... 451/289
5,803,799 A 9/1998 Volodarsky et al. ..... 451/288
5,851,140 A 12/1998 Barns et al.
5,857,667 A 1/1999 Lee
5,861,055 A 1/1999 Allman et al.
5,865,666 A 2/1999 Nagahara
5,868,608 A 2/1999 Allman et al.
5,882,251 A 3/1999 Berman et al.
5,888,120 A 3/1999 Doran
5,893,756 A 4/1999 Berman et al.
5,916,015 A 6/1999 Natalicio ..... 451/288
5,916,016 A 6/1999 Bothra ..... 451/398
5,931,719 A 8/1999 Nagahara et al.
5,941,758 A * 8/1999 Mack ..... 451/41
5,948,697 A 9/1999 Hata
5,957,757 A 9/1999 Berman

* cited by examiner

METHOD AND APPARATUS FOR USING ACROSS WAFER BACK PRESSURE DIFFERENTIALS TO INFLUENCE THE PERFORMANCE OF CHEMICAL MECHANICAL POLISHING

BACKGROUND OF THE INVENTION

1. Field of Invention

The present invention relates generally to methods and apparatus for polishing the surface of a semiconductor wafer using a chemical mechanical polishing process. More particularly, the present invention relates to methods and apparatus for applying pressure differentials on the back side of a semiconductor wafer to improve the performance of chemical mechanical polishing processes.

2. Description of Relevant Art

Chemical mechanical polishing, which is often referred to as "CMP," typically involves mounting a wafer, faced down, on a holder and rotating the wafer face against a polishing pad mounted on a platen. The platen is generally either rotating or in an orbital state. A slurry containing a chemical that chemically interacts with the facing wafer surface layer and an abrasive that physically removes portions of the surface layer is flowed between the wafer and the polishing pad, or on the pad in the vicinity of the wafer.

In semiconductor wafer fabrication, CMP is often utilized in an effort to planarize various wafer layers which may include layers such as dielectric layers and metallization layers. The planarity of the wafer layers is crucial for many reasons. For example, during wafer fabrication, planar layers reduce the likelihood of the accidental coupling of active conductive traces between different metallization layers, e.g., layers of active conductive traces, on integrated circuits housed on the wafer. Planar layers further provide a surface with a constant height for any subsequent lithography processes.

Polishing pressure, or the pressure applied to a wafer by a polishing pad, is generally maintained at a constant, e.g., uniform, level across the wafer. A uniform polishing pressure is maintained in an effort to ensure that the same amount of material, or film, is removed from all sections on the surface of a wafer. The amount of material removed from the surface of a wafer is governed by Preston's Equation, which states that the amount of material removed from the surface of a wafer is proportional to the product of the polishing pressure and the relative velocity of the wafer. The relative velocity of the wafer is generally a function of the rotation of the wafer. Using Preston's Equation, if the relative velocity of the wafer is maintained at a constant level, and the polishing pressure is at a uniform level across the wafer, then the amount of material removed from the wafer is constant.

During CMP, a wafer is held against a polishing pad with a uniform downforce such that the surface of the wafer may be evenly polished by the polishing pad. FIG. 1 is a diagrammatic cross-sectional representation of a wafer carrier assembly which may be used with a CMP apparatus such as an Avantgaard 676, available commercially from Integrated Processing Equipment Corporation (IPEC) of Phoenix, Ariz. A wafer carrier assembly 104 is generally used to transport a wafer 112 in order to position wafer 112 over a polishing pad 124, which is mounted on a platen 125. Wafer carrier assembly 104 typically includes a wafer carrier 106, or carrier plate, a wafer carrier film 108, and a retaining ring 110. Wafer 112 is supported by wafer carrier assembly

104 such that when a negative pressure, i.e., a vacuum, is applied through vacuum inlet 116 when wafer 112 is to be moved over a polishing pad 124, the negative pressure "permeates" openings 120 in wafer carrier 106 and wafer carrier film 108 to force wafer 112 against carrier film 108. That is, the vacuum created through openings 120 essentially suctions wafer 112 against carrier film 108 for transport.

When wafer 112 comes into contact with polishing pad 124 for polishing purposes, the vacuum applied through vacuum inlet 116 is released, and wafer 112 may be held against polishing pad 134 with a uniform back pressure applied by a pneumatic cylinder mechanism (not shown). In general, wafer carrier assembly 104 includes a shaft 126 which is coupled to a pneumatic cylinder mechanism (not shown) that is arranged to apply a downforce on wafer 112 in order to polish a front side 128 of wafer 112 using polishing pad 124. The downforce on wafer 112 is applied when the pneumatic cylinder mechanism presses down on wafer carrier assembly 104.

Once a polishing pad has been repeatedly used, e.g., is near the end of its pad life, the effectiveness of the polishing pad decreases. Since replacing polishing pads is time-consuming and expensive, a polishing pad is typically repeatedly used until non-uniformity on the surfaces of wafers polished using the polishing pad is at a level which is considered to be unacceptable. Generally, after a polishing pad has been repeatedly used to polish wafers over a period of time, the polishing pad has a tendency to become "glazed." As is well known in the art, pad glazing occurs when the particles eroded from wafer surfaces, in addition to particles from abrasives in the slurry, glaze or otherwise accumulate over the polishing pad.

Pad glazing is generally most evident during CMP performed on an oxide layer such as a silicon dioxide layer. Herein and after, CMP performed on an oxide layer will be referred to as "oxide CMP." During oxide CMP, eroded silicon dioxide particulate residue, along with abrasives in the slurry, have the tendency to glaze the polishing pad. When pad glazing occurs, the polishing rate of the wafer surface is reduced, and a non-uniformly polished wafer surface is produced due to uneven removal of the glaze.

In general, during CMP, as the number of wafers processed using a particular polishing pad increases, the material, or film, removal rate near the axial center of the wafer typically becomes increasingly slower due to pad glazing. Pad conditioning generally helps to prevent the glazing effect. However, as the polishing pad degrades, film removal non-uniformity increases. The film removal non-uniformity typically results in faster film removal at the wafer edge than near the center of the wafer. The increasingly slower material removal rate near the center of the wafer is generally known as "center-slow" polishing. In order to compensate for center-slow polishing, pad conditioning may also be used to shape the profile of a polishing pad such that contact between the polishing pad and the center of a wafer is increased. In general, a polishing pad is fabricated from a material such as a compressible poromeric polyurethane. As will be appreciated by those skilled in the art, conditioning of a compressible poromeric polyurethane becomes less effective after repeated conditioning.

Increasing the contact between a polishing pad and the center of the wafer results in an increased polish rate at the center of the wafer. However, conditioning the polishing pad has the tendency to become less effective as the polishing pad ages. Further, replacing polishing pads is both time-consuming and expensive. Hence, prolonging the life of a polishing pad while reducing film removal non-uniformity is desirable. As such, what is desired is a method and apparatus for reducing wafer surface non-uniformity that occurs during CMP after a polishing pad has been used repeatedly. In other words, what is desired is a method and apparatus slows down the film removal non-uniformity degradation.

SUMMARY OF THE INVENTION

In accordance with the present invention, non-uniform pressure distributions are provided across the back side of a semiconductor wafer to enable polishing pressure to be varied across the wafer and, hence, the polishing pad which is used to polish the wafer during a chemical mechanical polishing (CMP) process. Varying the polishing pressure across the polishing pad enables problems which may arise when a polishing pad has been used repeatedly, e.g., center slow polishing, to be alleviated. By way of example, to compensate for center slow polishing, the pressure applied around the axial center of the wafer may be higher than pressures applied away from the center of the wafer.

According to one aspect of the present invention, a chemical mechanical polishing apparatus for polishing a first surface of a semiconductor wafer includes a polishing pad which polishes the first surface of the semiconductor wafer. The apparatus also includes a first mechanism which is used to hold, or otherwise support, the wafer during polishing, and a second mechanism that is used to apply a non-uniform pressure distribution through the first mechanism, directly onto a second surface of the wafer. The second mechanism is further used to facilitate polishing the first surface of the semiconductor wafer such that the first surface of the semiconductor wafer is evenly polished. In one embodiment, the second mechanism is arranged to apply both positive pressure and negative pressure substantially simultaneously across the second surface of the semiconductor wafer.

According to another aspect of the present invention, a chemical mechanical polishing apparatus for polishing a first surface of a semiconductor wafer includes a polishing pad which polishes the first surface of the wafer and a mechanism which applies a non-uniform pressure distribution directly across portions of a second surface of the wafer. The mechanism also supports the wafer while the first surface of the wafer is being polished. In one embodiment, the mechanism for applying the non-uniform pressure distribution includes a retaining ring, a carrier, and a carrier film which cooperate to support the wafer. In such an embodiment, the mechanism may also include an air supply which provides the non-uniform pressure distribution along the second surface of the wafer.

In another embodiment, a carrier and a carrier film are used to facilitate the application of the non-uniform pressure distribution along the second surface of the wafer. In such an embodiment, a plurality of openings, coupled to an air supply, are defined through both the carrier and the carrier film to provide the non-uniform pressure distribution along the second surface of the semiconductor wafer.

According to yet another aspect of the present invention, a method for planarizing a first surface of a semiconductor wafer using chemical mechanical polishing includes holding the wafer over a chemical mechanical polishing pad. A non-uniform pressure distribution is then applied directly over a second surface of the wafer, and the first surface of the wafer is polished with the chemical mechanical polishing pad. In one embodiment, applying the non-uniform pressure distribution over the second surface of the wafer involves simultaneously applying both a positive pressure and a negative pressure. In another embodiment, pressurized air is applied directly over the second surface of the semiconductor wafer.

These and other features and advantages of the present invention will be presented in more detail in the following detailed description of the invention and in the associated figures.

BRIEF DESCRIPTION OF THE DRAWINGS

The invention may best be understood by reference to the following description taken in conjunction with the accompanying drawings in which.

DETAILED DESCRIPTION OF THE EMBODIMENTS

The planarity, or uniformity, of the surface of a semiconductor wafer layer is important for a number of different reasons. For example, ensuring the planarity of the surface of a semiconductor wafer reduces the likelihood of accidentally coupling metallization lines in different metallization layers of the semiconductor wafer. One process which is used to form planar surfaces on a wafer is chemical mechanical polishing (CMP). While CMP is generally effective in forming planar surfaces on wafers, when polishing pads used in CMP become glazed, the polishing rate of wafer surfaces may be reduced. As a polishing pad degrades, the film removal non-uniformity also degrades. As a result, non-uniformly polished wafer surfaces may be produced due to uneven removal of the glaze. Specifically, in many cases, center-slow polishing occurs which causes the portion of a wafer around the axial center of the wafer to be polished to a lesser extent than other portions of the wafer.

By applying a pressure differential across the back of a semiconductor wafer, the wafer may be bowed to promote contact between particular portions of the wafer and a polishing pad. Therefore, the polishing pad may consistently and uniformly polish the wafer surface, even after the polishing pad has been used extensively, or is otherwise approaching the end of its pad life. Specifically, applying pressure differentials across the back side of a wafer allows polishing pressures exerted between the polishing pad and the surface of a wafer to be varied. As such, by varying pressures applied across the back side of a wafer as necessary, polishing pressures across a wafer may then be effectively varied to enable a CMP process to produce a planar surface on the wafer. In other words, the film removal rate may be varied by varying the polishing pressure. For example, less material is removed from the surface of a wafer as the polishing rate of the wafer decreases. Hence, by increasing the polishing pressure, the amount of material removed from the wafer may be increased. In general, polishing pressures may be varied between both positive pressures and negative pressures, e.g., vacuums. Further, both a positive pressure and a negative presssure may be simultaneously applied across different sections of the wafer to achieve differential polishing pressures across the wafer.

A pressure differential, or a non-uniform pressure distribution, may be created across the back side of a wafer by including a plurality of air sources, coupled to a plurality of air lines. The air sources and the air lines may provide air pressurized to different pressures directly to the wafer to thereby create a non-uniform pressure distribution across the wafer.

Figure 1:
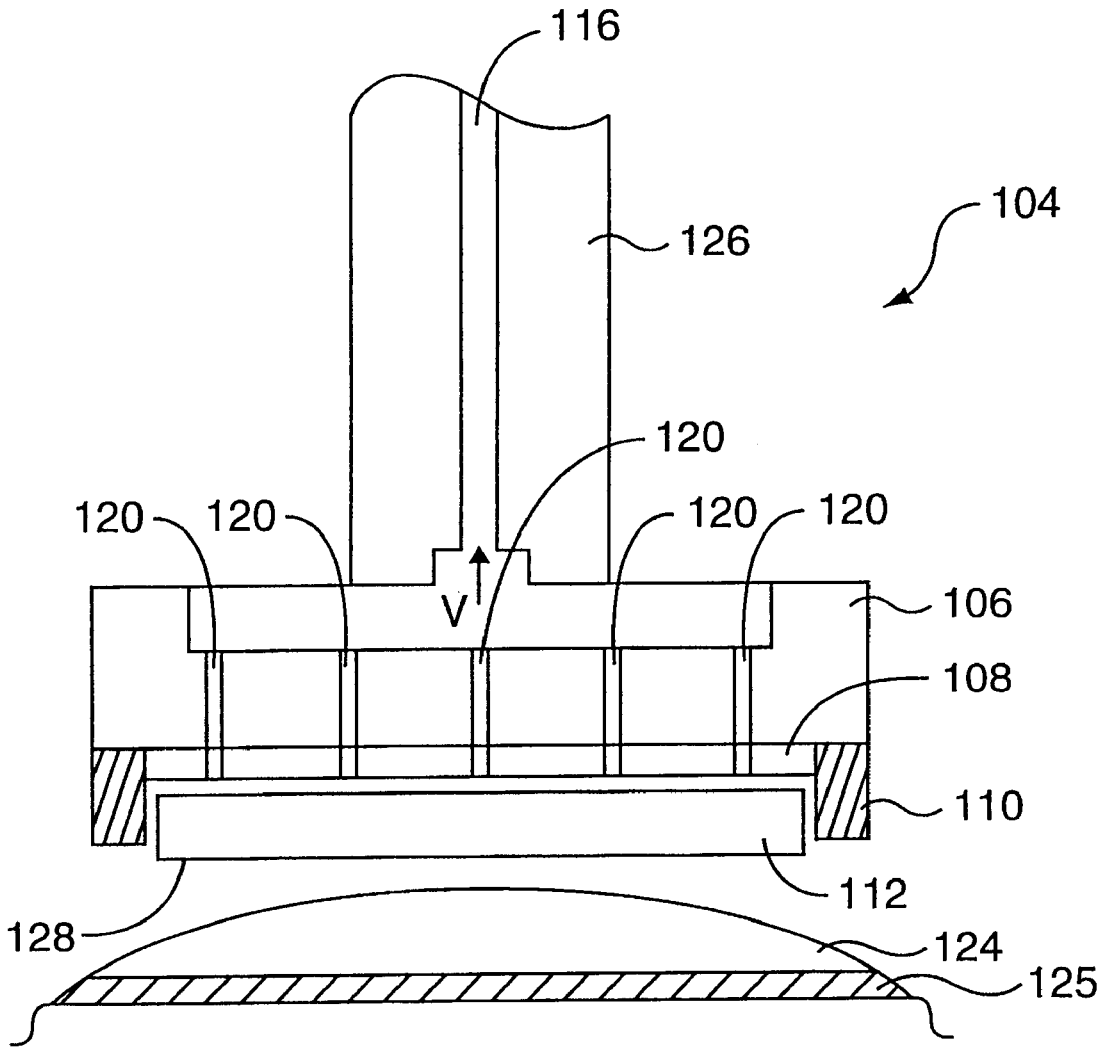
Figure 1 (Prior Art)
FIG. 1 is a diagrammatic cross-sectional representation of a wafer carrier assembly which is a part of a chemical mechanical polishing apparatus in accordance with prior art.
Figure 2A:
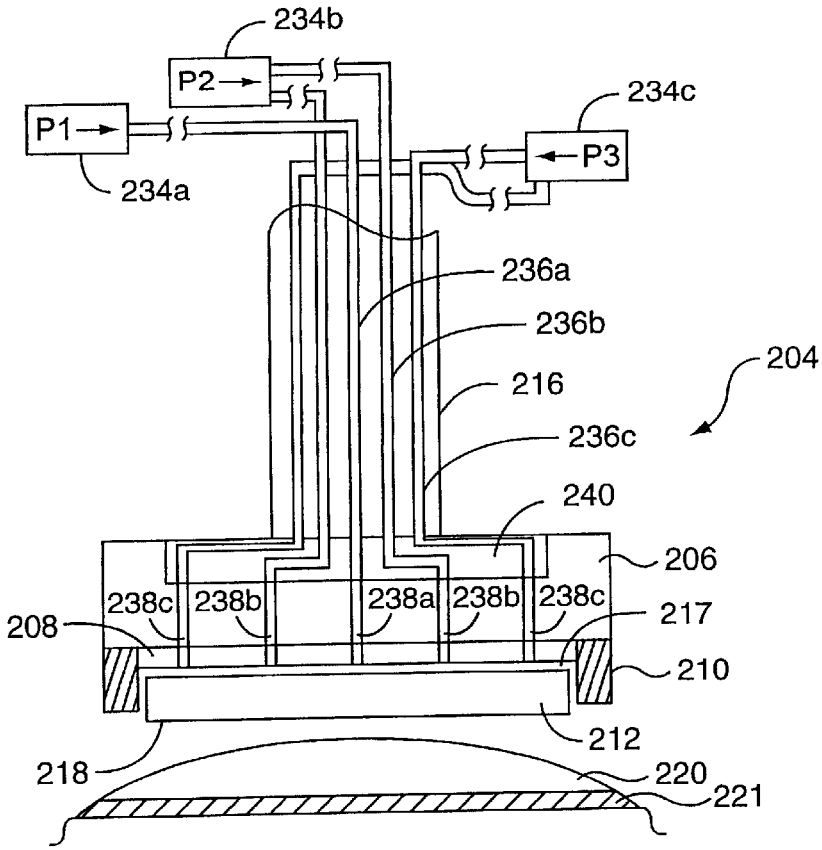
FIG. 2*a* is a diagrammatic cross-sectional representation of a wafer carrier assembly which is arranged to apply a non-uniform pressure distribution to a back side of a wafer in accordance with a first embodiment of the present invention.

Referring next to FIG. 2*a*, a wafer carrier assembly 204 which is arranged to apply a non-uniform pressure distribution directly to a back side 217 of a wafer 212 will be described in accordance with a first embodiment of the present invention. As shown, the features and dimensions of wafer carrier assembly 204 have been exaggerated for purposes of discussion. Wafer carrier assembly 204 includes a wafer carrier 206, a wafer carrier film 208, and a retaining ring 210. Wafer 212 is supported by wafer carrier assembly 204, which further includes a shaft 216 that is coupled, in one embodiment, to a pneumatic cylinder mechanism (not shown). In general, a pneumatic cylinder mechanism, or an equivalent mechanism, is arranged to apply a downforce on back side 217 of wafer 212 while a front side 218 of wafer 212 is polished against a polishing pad 220 which is mounted on a platen 221. While polishing pad 220 has been shown as having a smaller diameter than wafer 212, it should be appreciated that in some embodiments, polishing pad 220 has a larger diameter than wafer 212. By way of example, wafer 212 may have a diameter of approximately six inches to approximately eight inches, while polishing pad 220 may have a diameter of approximately ten inches.

Air sources 234, e.g., sources of nitrogen, provide air through air lines 236 which pass through a sealing space 240, in one embodiment. Air is generally passed through air lines 236 such that air flows through openings 238 in wafer carrier 206 and carrier film 208 to substantially directly contact back side 217 of wafer 212. One embodiment of a pattern of openings 238 in wafer carrier 206 and, hence, carrier film 208 will be described in more detail below with respect to FIG. 2*b*. As will be appreciated by those skilled in the art, carrier film 208 is typically a thin, polymeric film which is intended to cushion wafer 212. In some embodiments, carrier film 208 may not be included as part of wafer carrier assembly 204.

In order to provide a non-uniform pressure distribution on back side 217 of wafer 212 to facilitate the even polishing of front side 218 of wafer 212, the air which passes through air lines 236 may be at different pressures. By way of example, as shown, air which passes through air line 236*a* is at a first pressure PI, while air which passes through air lines 236*b* is at a second pressure P2. Similarly, air which passes through air lines 236*c* is at a third pressure. By including a plurality of air lines 236, the pressures on the back side 217 of wafer 212 may be finely controlled, as different air lines 236 may be used to essentially control the polishing pressure on different sections of wafer 212.

In general, air pressures P1, P2, and P3 may be widely varied. For example, air pressure P1 may be a negative pressure, i.e., a vacuum, while air pressures P2 and P3 may be positive pressures. The magnitudes of air pressures P1, P2, and P3 may also be widely varied, and are generally chosen based upon the desired uniformity front side 216 of wafer 212. In general, the magnitudes of air pressures P1, P2, and P3 will not exceed the downforce applied on wafer 212 by a pneumatic cylinder mechanism (not shown). In one embodiment, the magnitudes of air pressures P1, P2, and P3 will not exceed a value which is greater than approximately seventy percent of the magnitude of the downforce, which may be, but is not limited to being, in the range of approximately five to approximately ten pounds-per-square inch (psi). By way of example, when the -downforce is approximately 7 psi, the magnitudes of air pressures P1, P2, and P3 may be in the range of approximately 0.5 psi to approximately 3 psi.

As polishing pad 220 reaches the end of its life, when wafer 212 is polished using polishing pad 220, center-slow polishing tends to occur. In other words, the area of wafer 212 near the axial center of wafer 212 may be polished to a lesser extent than areas of wafer 212 which are further from the axial center. In order to compensate for center-slow polishing, air pressure P1 may be greater than air pressure P2 which, in turn, may be greater than air pressure P3. Increasing the air pressure on back side 217 of wafer 212 near the axial center of wafer 212 with respect to the air pressure on back side 217 of wafer 212 away from the axial center of wafer 212 allows the area of front side 218 near the axial center of wafer 212 to be polished at a faster rate. That is, the portion of front side 218 of wafer 212 may be slightly bowed out with respect to other portions of wafer 212.

Figure 2B:
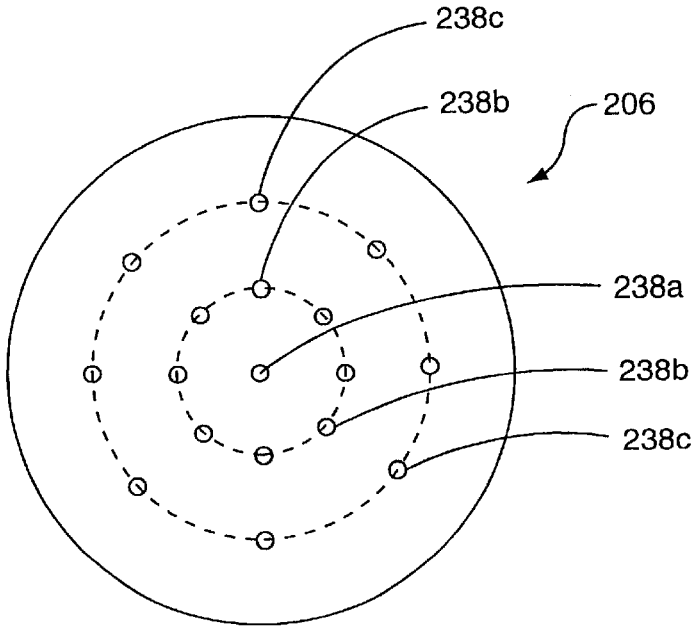
FIG. 2*b* is a diagrammatic top-view representation of a wafer carrier in accordance with the first embodiment of the present invention.

The distribution of pressure on back side 217 of wafer 212 may be varied depending upon the pattern of cylindrical openings 238 in wafer carrier 206 and carrier film 208. FIG. 2*b* is a diagrammatic top-view representation of one pattern of openings 238 in wafer carrier 206 in accordance with the first embodiment of the present invention. Openings 238 are arranged as substantially concentric circles with respect to the axial center of wafer carrier 206. Arranging openings 238 in substantially concentric circles enables pressure to be distributed across back side 217 of wafer 212 in a concentric, circular pattern as will be appreciated by those skilled in the art. As shown, opening 238*a* is located approximately at the axial center of wafer carrier 206, while openings 238*b* and openings 238*c* are patterned on concentric circles which are substantially centered around opening 238*a*.

Although the air pressure which passes through all openings 238 may be different, e.g., separate air lines 236 may be associated with each opening 238, in the described embodiment, opening 238*a* is associated with air pressure P1, openings 238*b* are associated with air pressure P2, and openings 238*c* are associated with air pressure P3. Accordingly, as described above, to compensate for center-slow polishing, air pressure P1 may be higher than air pressure P2, which may be higher than air pressure P3. Alternatively, to compensate for center-fast polishing, i.e., to compensate for a higher polishing rate near the edges of wafer 212, air pressure P3 may be higher than air pressure P2, which may be higher than air pressure P1.

By providing openings 238 in wafer carrier 206 such that air pressure may be applied directly to back side 217 of wafer 206, wafer carrier 206 may remain substantially rigid during a CMP process. Minimizing any flexing in wafer carrier 206 during CMP protects the integrity of wafer carrier assembly 204, e.g., may reduce the wear of wafer carrier 206, and, hence, any wafer 212 polished using wafer carrier assembly 204.

As described above, to generate a non-uniform pressure distribution across the back side of a wafer, a plurality of air lines may be implemented in a wafer carrier system to substantially simultaneously apply different pressures to the back side of the wafer. Alternatively, a single air line, coupled to a single air source, may also be used to create a non-uniform pressure distribution across the back side of a wafer, as will be described with respect to FIG. 3*a*. When a single air line is used, modifications may be made to a wafer carrier, or a carrier plate, to create the non-uniform pressure distribution.

Figure 3A:
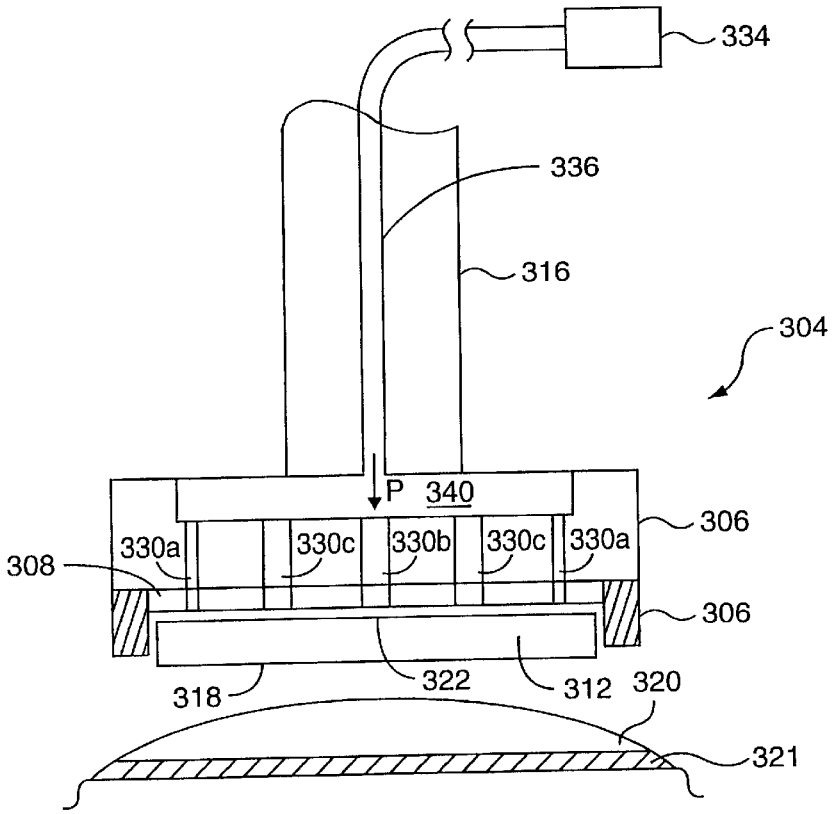
FIG. 3*a* is a diagrammatic cross-sectional representation of a wafer carrier assembly which is arranged to apply a non-uniform pressure distribution to a back side of a wafer in accordance with a second embodiment of the present invention.

FIG. 3*a* is a diagrammatic cross-sectional representation of a wafer carrier assembly with a wafer in accordance with a second embodiment of the present invention. A wafer carrier assembly 304 includes a wafer carrier 306, a wafer carrier film 308, and a retaining ring 310. A wafer 312 is supported by wafer carrier assembly 304, as will be appreciated by those skilled in the art. Wafer carrier assembly 304 further includes a shaft 316 which is generally coupled to a pneumatic cylinder mechanism (not shown), or any other suitable mechanism that is arranged to apply a downforce on wafer 312 while a front side 318 of wafer 312 is polished against a polishing pad 320 which is supported on a platen 321.

An air source 334, e.g., a source of nitrogen, provides air through an air line 336 to sealing space 340. It should be appreciated that the air provided by air source 334 may be at any suitable pressure P. In order to provide a non-uniform pressure distribution on a back side 322 of wafer 312 such that the even polishing of front side 318 of wafer 312 is facilitated, openings 330 of varying diameters are provided in wafer carrier 306 and wafer carrier film 308. The range of suitable diameters for openings 330 may be widely varied. By way of example, in one embodiment, diameters may be in the range of approximately 0.03 millimeters to approximately 1 millimeter. One embodiment of wafer carrier 306, with openings 330 of varying diameters, will be described below with reference to FIG. 3*b*.

In the described embodiment, the pressure distribution on back side 322 of wafer 312 is dependent upon both the pattern of openings 330 in wafer carrier 306 and carrier film 308 and the relative size of openings 330. Although the pattern of openings 330 may be widely varied, one particularly suitable pattern of openings 330 is an essentially concentric pattern of openings. Although air which flows through air line 336 is typically at a single pressure, when the air is dispersed within sealing space 340 and passed through openings 330, due to the fact that openings 330 are of different diameters, e.g., opening 330*c* has a larger diameter than opening 330*a*, the pressure of air passing through opening 330*c* will be different from the pressure of air passing through opening 330*a*.

Figure 3B:
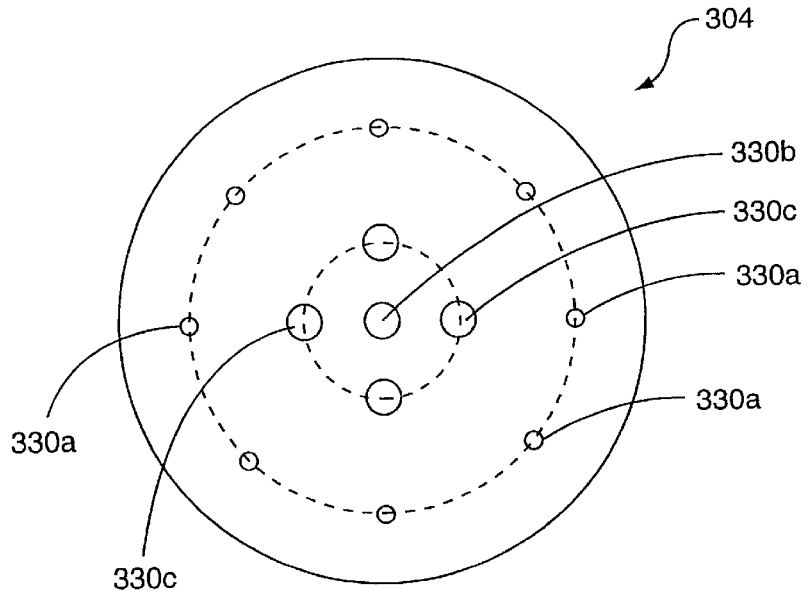
FIG. 3*b* is a diagrammatic top-view representation of a wafer carrier in accordance with the second embodiment of the present invention.

Referring next to FIG. 3*b*, one pattern of openings 330 of different sizes in wafer carrier 306 will be described in accordance with a second embodiment of the present invention. Openings 330 are arranged as substantially concentric circles with respect to the axial center of wafer carrier 306. As shown, opening 330*b* is located approximately at the axial center of wafer carrier 306, while openings 330*a* and openings 330*c* are located along concentric circles which are substantially centered around opening 330*b*.

As previously mentioned with respect to FIG. 3*a*, in the described embodiment, openings 330*c* have a larger diameter than openings 330*a*. Opening 330*b*, as shown, has approximately the same diameter as openings 330*c*. Varying the sizes of openings 330 on wafer carrier 306 enables a single source of air pressure, e.g., air source 334, to create a non-uniform pressure distribution on back side 322 of wafer 312. By way of example, when air pressure provided through air line 336 is a negative air pressure, or a vacuum, then a higher vacuum may be produced through openings 330*a* than through openings 330*b*, 330*c*. As such, wafer 312, when subjected to pressurized air through openings 330, may be bowed such that the portion of wafer which is "suctioned" through openings 330*b*, 330*c* may be polished to minimize the effects of center-slow polishing.

Figure 4:
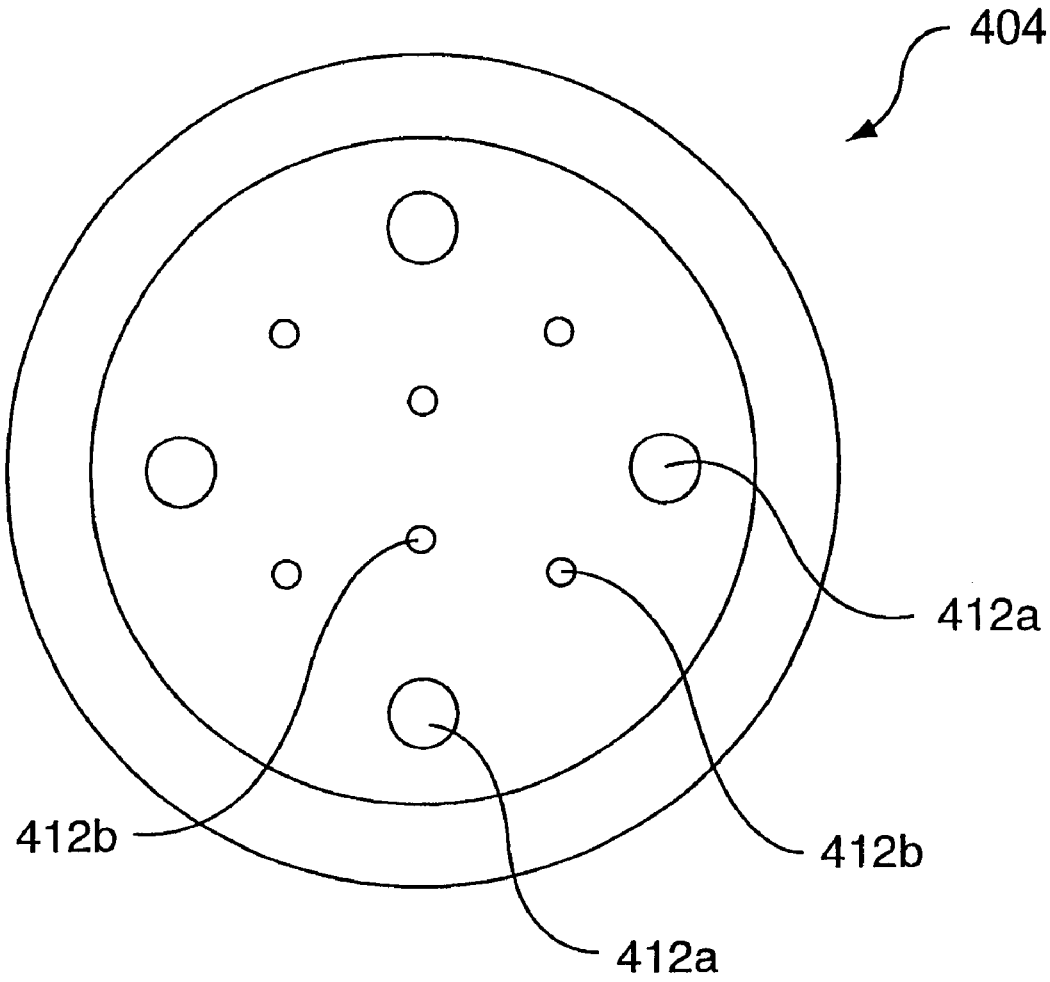
FIG. 4 is a diagrammatic representation of a top view of a wafer carrier in accordance with a third embodiment of the present invention.

Openings in a wafer carrier may generally be arranged in any suitable configuration, and are not limited to being organized in a pattern of concentric circles. Specifically, openings may be situated on a wafer carrier at specific locations determined by an acceptable level of uniformity for a polished surface of a wafer. That is, openings are arranged to provide a pattern of pressure distribution across the back side of a wafer which allows the front side of the wafer to be polished to a desired level of uniformity. FIG. 4 is a diagrammatic representation of a top view of a wafer carrier in accordance with a third embodiment of the present invention. A wafer carrier 404 includes a plurality of openings 412. As shown, openings 412*a* have diameters which are larger than those of openings 412*b*. Openings 412 are arranged such that the central portion of wafer carrier 404 includes smaller openings 412*a*, while the peripheral portion of wafer carrier 404 includes larger openings. Accordingly, a wafer which is held in a wafer carrier assembly which uses wafer carrier 404 may have one pressure applied across the central portion of the wafer, and another pressure applied across the peripheral portion of the wafer. Such an arrangement of openings 412 in wafer carrier 404 may be suitable to promote contact between a central portion of a wafer and a polishing pad.

Although only a few embodiments of the present invention have been described, it should be understood that the present invention may be embodied in many other specific forms without departing from the spirit or the scope of the present invention. By way of example, although openings in a wafer carrier and, hence, a carrier film have been described as being cylindrical, it should be appreciated that the openings may take on a variety of different shapes, as well as sizes. In one embodiment, openings may be conically shaped to produce a nozzle effect in terms of directing pressurized air at the back side of a wafer.

While openings of different diameters in a wafer carrier have been described as being associated with a wafer carrier system which has a single air line, in general, openings of different diameters may be implemented for use with a wafer carrier system which includes a plurality of air lines and, hence, a plurality of air sources. By way of example, a single, large opening which is coupled to a first air source may be located at the axial center of a wafer carrier, while multiple smaller openings which are coupled to a second air source may be located nearer to the periphery of the wafer carrier, without departing from the spirit or the scope of the present invention.

In addition to providing a non-uniform back pressure on the back side of a wafer during CMP, the density associated with the non-uniform back pressure may also be modified. For example, rather than arranging openings in a wafer carrier in concentric circles, openings of the same size and shape may be arranged such that one portion of the wafer carrier may have more concentrated openings than another portion. By varying the density of openings in a wafer carrier, the density of the back pressure applied to a wafer held by the wafer carrier may be varied.

The application of a non-uniform back pressure on the back side of a wafer has been described as enabling the bowing of the wafer to be controlled in order to control the uniformity of a polishing process by affecting the contact between a polishing pad and the wafer. However, it should be appreciated that the application of a non-uniform back pressure on the back side of a wafer during polishing also serves to secure the wafer and, therefore, prevent the wafer from rotating during polishing. For example, a non-uniform vacuum may be applied to the back side of a wafer during polishing.

Further, during CMP, polishing inconsistency may occur near a wafer carrier contact point, as for example the contact point between a wear ring and a wafer. Generally, the edge of a wafer is polished faster than the center of the wafer, due to the compression of the polishing pad. By varying the back pressure applied to the wafer such that a vacuum is applied near the edge of the wafer while higher pressures are applied to other portions of the wafer, the edge exclusion problem may be solved without departing from the spirit or the scope of the present invention. Therefore, the present examples are to be considered as illustrative and not restrictive, and the invention is not to be limited to the details given herein, but may be modified within the scope of the appended claims.

What is claimed is:

1. A method for planarizing a first surface of a semiconductor wafer using chemical mechanical polishing, the method comprising:

holding the semiconductor wafer over a chemical mechanical polishing pad;

applying a non-uniform pressure distribution directly over a second surface of the semiconductor wafer, said non-uniform pressure distribution comprising a plurality of different positive pressures and at least one negative pressure applied simultaneously at different positions over the second surface of the semiconductor wafer; and polishing the first surface of the semiconductor wafer using the chemical mechanical polishing pad, wherein the non-uniform pressure distribution is applied directly over the second surface of the semiconductor wafer while the first surface of the semiconductor wafer is polished.

2. A method as recited in claim 1 wherein applying the non-uniform pressure distribution directly over the second surface of the semiconductor wafer includes applying pressurized air directly over the second surface of the semiconductor wafer.

3. A method as recited in claim 1, wherein applying the non-uniform pressure distribution directly over the second surface of the semiconductor wafer includes applying a vacuum directly over the second surface of the semiconductor wafer.

4. A method as recited in claim 1, wherein the non-uniform pressure distribution applied directly over the second surface of the semiconductor wafer comprises air pressures P1, P2, and P3.

5. A method as recited in claim 4, wherein air pressure P1 is a negative pressure, and air pressures P2 and P3 are positive pressures.

* * * * *